US009007226B2

(12) United States Patent
Chang

(10) Patent No.: US 9,007,226 B2
(45) Date of Patent: Apr. 14, 2015

(54) FLEXIBLE DISPLAY DEVICE AND METHOD FOR SENSING BENDING DEFORMATION

(75) Inventor: Min-Su Chang, Incheon (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 167 days.

(21) Appl. No.: 13/616,621

(22) Filed: Sep. 14, 2012

(65) Prior Publication Data

US 2013/0127606 A1 May 23, 2013

(30) Foreign Application Priority Data

Nov. 23, 2011 (KR) ..... 10-2011-0122742

(51) Int. Cl.
*G08B 21/00* (2006.01)
*G09G 3/00* (2006.01)

(52) U.S. Cl.
CPC ..... *G09G 3/006* (2013.01)

(58) Field of Classification Search
CPC ..... G09G 3/006
USPC ..... 340/635, 540; 361/679.21, 679.26
See application file for complete search history.

(56) References Cited

U.S. PATENT DOCUMENTS

| | | | | |
|---|---|---|---|---|
| 7,586,739 | B2 * | 9/2009 | Weksler et al. | 361/679.26 |
| 7,591,187 | B2 * | 9/2009 | Hamel | 73/778 |
| 2007/0222764 | A1 * | 9/2007 | Wang | 345/173 |
| 2010/0053068 | A1 | 3/2010 | Cohen et al. | |

FOREIGN PATENT DOCUMENTS

EP 2 463 848 A1 6/2012

OTHER PUBLICATIONS

Anonymous; "Flexible Circuit Design Guide-Fourth Edition;" Teledyne Electronic Technologies; Jan. 31, 2000; URL:http://www.oemmarketing.com/Elements/portfolio/Copywriting/DesignersGuide_TET.pdf(Rtrvd. from internet on Feb. 1, 2013); XP002691486.

Anonymous; "Sectional Design Standard for Flexible Printed Boards"; IPC; Nov. 30, 1998; URL: http://222.184.16.210/smt/tzxt/bz/IPC-2223.pdf(Rtrvd. from Internet on Feb. 1, 2013); XP002691487.

* cited by examiner

*Primary Examiner* — Jeffery Hofsass
(74) *Attorney, Agent, or Firm* — Cha & Reiter, LLC.

(57) ABSTRACT

A display device and a method for controlling the same are provided, in which a flexible display panel is provided, and a plurality of strain gauges are arranged on at least one surface of the flexible display panel to sense bending deformation of the flexible display panel.

8 Claims, 4 Drawing Sheets

FLEXIBLE DISPLAY DEVICE AND METHOD FOR SENSING BENDING DEFORMATION

CLAIM OF PRIORITY

This application claims priority under 35 U.S.C. §119(a) to a Korean Patent Application filed in the Korean Intellectual Property Office on Nov. 23, 2011 and assigned Serial No. 10-2011-0122742, the contents of which are incorporated herein by reference.

BACKGROUND OF THE INVENTION

1. Field of the Invention

The present invention relates to a display device, and more particularly, to a display device with a flexible display panel and a method for controlling the same.

2. Description of the Related Art

In general, a display device displays information and controls the operation states of its device, such as a TV in a home, electronic products, a car, mechanical equipment, etc.

Along with the increasing popularity of mobile communication service, display devices for portable terminals have been drastically evolved. In its early development stage of the mobile application, the display device merely displayed simple characters. Now, its technology has advanced remarkably enough to display high-definition pictures or videos.

Due to the requirement of portability, the portable terminal needs to be compact and lightweight. As multimedia service is now readily available, the display devices of the portable terminals tend to be larger. However, there are restrictions on extending a display device, while maintaining a portable terminal compact and lightweight. As the display device area is made larger, efforts have been made mainly on a reduction of the thickness of the portable terminal with an incorporation of a touch screen, instead of a physical keypad.

Since a virtual keypad can be configured on a screen, a touch screen display device can eliminate the physical keypad from the portable terminal. Accordingly, a portable terminal equipped with a touch screen display device can offer a larger screen than a general portable terminal without it. Thus, the portable terminal having a touch screen display device is more favorable.

Recently, a technology for bending or folding a display device by fabricating the display device with a flexible display panel has been proposed. As the larger display device can be bent or folded, the portability of a portable terminal such as a mobile communication terminal can be enhanced. For example, a flexible display device is disclosed in Korea Patent Publication No. 2009-87303 (published on Aug. 17, 2009).

FIG. 1 illustrates a folded flexible display panel in a conventional display device. As shown, in a state where the flexible display panel is bent or folded, tensile force is applied to the outer surface of the flexible display panel, thus causing cracks on the outer surface of the flexible display panel. In addition, as the flexible display panel is bent or folded repeatedly, tensile load is also repeatedly applied on the outer surface of the flexible display panel. As a result, even though cracks are not produced, the flexible display panel is vulnerable to permanent deformation. However, permanent deformation or cracks of the flexible display panel may not be perceivable or visible to a user. As such, after damage or deformation, its cause cannot be analyzed during normal operation until it's too late.

SUMMARY OF THE INVENTION

An aspect of embodiments of the present invention is to address at least the problems and/or disadvantages and to provide at least the advantages described below. Accordingly, an aspect of embodiments of the present invention is to provide a display device for enabling a user to readily identify a strain caused by bending deformation of a flexible display panel, and a method for controlling the same.

Another aspect of embodiments of the present invention is to provide a display device for generating a warning signal so that a user may identify bending deformation of a flexible display panel and thus stop the deformation, before a strain tolerance is reached, and a method for controlling the same.

A further aspect of embodiments of the present invention is to provide a display device for facilitating a cause analysis by, upon the generation of permanent deformation or cracks on a flexible display panel, storing data about the deformation or cracks, and a method for controlling the same.

In accordance with an embodiment of the present invention, there is provided a display device in which a flexible display panel is provided, and a plurality of strain gauges is arranged on at least one surface of the flexible display panel and sense bending deformation of the flexible display panel.

In accordance with another embodiment of the present invention, there is provided a method for controlling a display device having a flexible display panel and a plurality of strain gauges arranged on at least one surface of the flexible display panel, for sensing bending deformation of the flexible display panel, in which a strain of the flexible display panel is measured, a warning signal is generated when it is sensed that the strain of the flexible display panel has reached a strain tolerance during measuring of the strain, and a warning screen is output by operating the flexible display panel according to the warning signal.

BRIEF DESCRIPTION OF THE DRAWINGS

The above features and advantages of certain embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF EMBODIMENTS

Reference will be made to preferred embodiments of the present invention with reference to the attached drawings. For the purposes of clarity and simplicity, a detailed description of a generally well-known function and structure of the present invention will be avoided as not to obscure the subject matter of the present invention.

Figure 1:
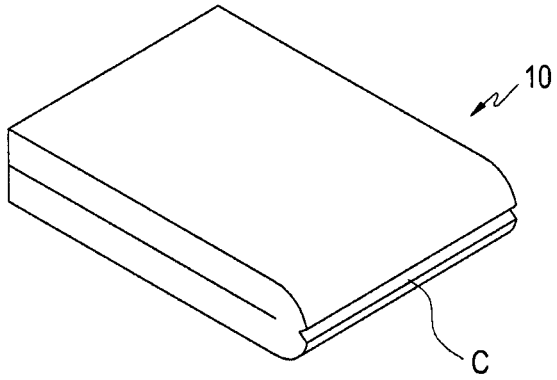
FIG.1 (RELATED ART)
FIG. 1 illustrates a folded flexible display panel in a conventional display device.
Figure 2:
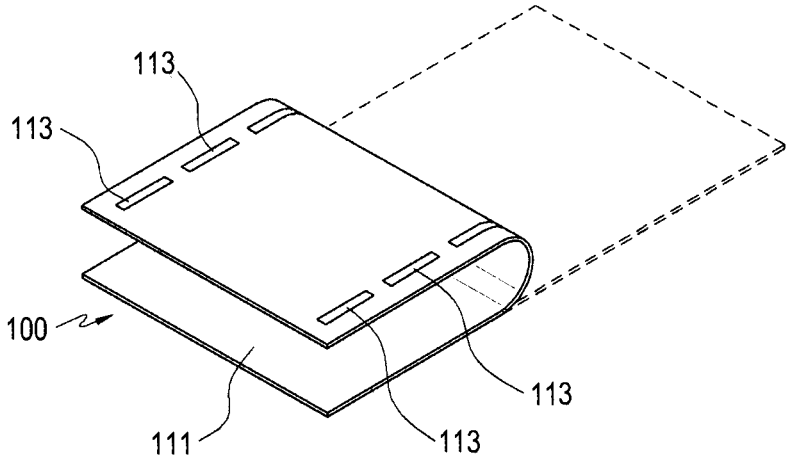
FIG. 2 illustrates a display device according to a preferred embodiment of the present invention.

Referring to FIG. 2, a display device 100 according to a preferred embodiment of the present invention includes a flexible display panel 111 and a plurality of strain gauges 113 arranged on one surface of the flexible display panel 111. The strain gauges 113 sense bending deformation of the flexible display panel 111 including any cracks on the flexible display panel 111.

Since the flexible display panel 111 is bent or folded relatively easily, it may be used to enhance the portability of a portable terminal. For example, if the flexible display panel 111 is carried, bent or folded and then, when needed, unfolded to be connected to a media device such as a portable terminal, thus allowing a user to easily carry around and use the display device 100 at any place.

The strain gauges 113 are a type of sensors measuring a strain based on the principle that when external force is applied to a conductive wire, the conductive wire is elastically extended. Thus, the resulting change in length and diameter of the conductive wire changes the total electrical resistance of the conductive wire.

When the flexible display panel 111 is bent or folded, tensile force is applied to its outer surface. Then, the strain gauges 113 measure the strain of the outer surface of the flexible display panel 111. The strain gauges 113 are attached to one surface of the flexible display panel 111. As shown, the strain gauges 113 are apart from each other by a predetermined distance along at least one side of the flexible display panel 111. More preferably, the strain gauges 113 are arranged at a predetermined interval along the entire periphery of the flexible display panel 111, that is, along four sides of the flexible display panel 111 on one surface of the flexible display panel 111. Therefore, when the flexible display panel 111 is deformed in any direction, its strain or cracks can be sensed.

Figure 3:
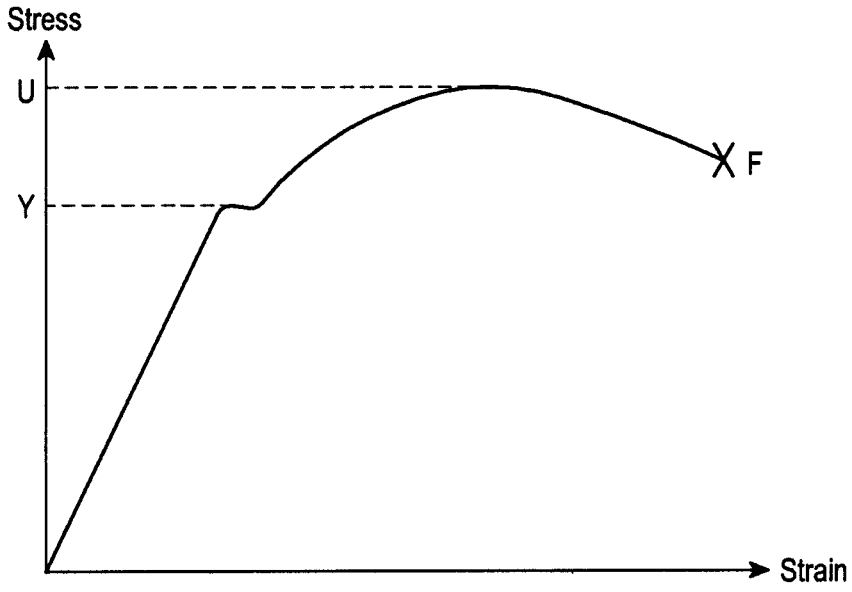
FIG. 3 illustrates a stress-strain curve of a flexible display panel in the display device illustrated in FIG. 2.

FIG. 3 illustrates a stress-strain curve of the flexible display panel 111. If an applied stress is equal to or smaller than a yield stress Y, the flexible display panel 111 is elastically deformed(a temporary shape change that is self-reversing after the force is removed to that the object returns to its original shape). On the other hand, if the applied stress is greater than the yield stress Y and smaller than a maximum stress U, the flexible display panel 111 is plastically deformed (when the stress is sufficient to permanently deform the object). When tensile force is continuously applied even after reaching the maximum stress, a vulnerable part of the flexible display panel 111 is extended and then eventually cracked and damaged as indicated by reference character F, despite a reduction in the tensile force.

Figure 6:
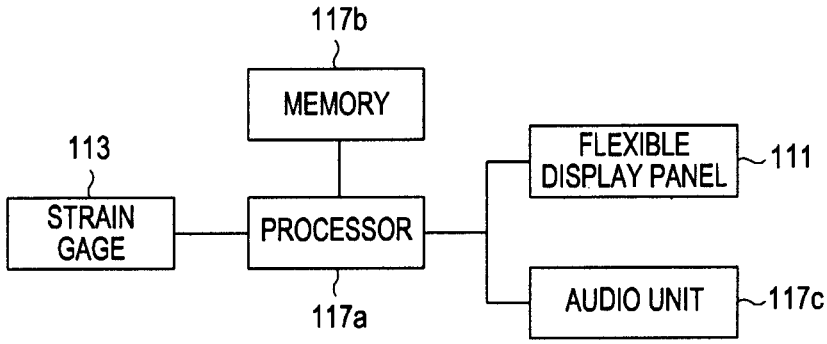
FIG. 6 is a diagram illustrating a circuit for processing a strain measured by the strain gage illustrated in FIG. 2.

The flexible display panel 111 may return to its original shape in an elastic deformation range, but seldom returns to its original shape in a plastic deformation range. Therefore, when the strain of the flexible display panel 111 measured by the strain gauges 113 reaches a strain tolerance, that is, the yield stress Y, it is preferred to generate a warning signal and thus emit an alarm sound or to output an alarm sound or a warning screen by operating the flexible display panel 111. FIG. 6 illustrates a circuit for processing the strain measured by the strain gage. The circuit shown in FIG. 6 includes the flexible display panel 111, the strain gage 113, a processor 117*a*, a memory 117*b* and an audio unit 117*c*. The processor 117*a* receives data, for example, the strain measured by the strain gage 113 and operates the flexible display panel 111 or the audio unit 117*c* to emit an alarm sound or to output an alarm sound when the flexible display panel 111 has reached a deformation tolerance. And the processor 117*a* saves the data in the memory 117*b* when the flexible display panel 111 is eventually permanently deformed, cracked, or fractured.

A user may recognize from the alarm sound or warning screen that the flexible display panel 111 has reached a deformation tolerance and thus may stop the deformation of the flexible display panel 111, that is, the display device 100.

Figure 5:
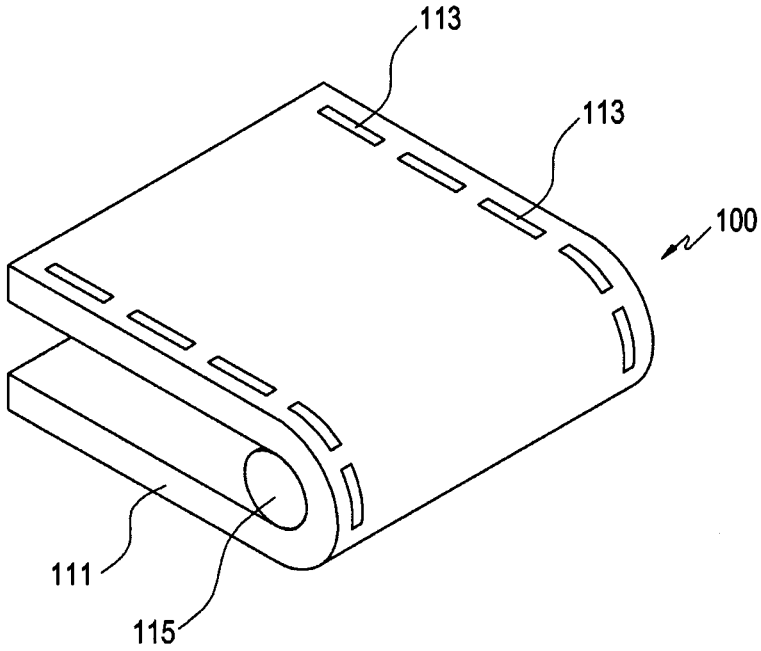
FIG. 5 illustrates a guide rod disposed to the display device illustrated in FIG. 2.

Referring to FIG. 5, a guide rod 115 may be installed in order to prevent excessive deformation of the flexible display panel 111. The guide rod 115 is disposed on the other surface of the flexible display panel 111, that is, an inner surface of the flexible display panel 111 that has been bent. Especially, when the display device 100 is installed so that folding is concentrated on its specific part, the use of the guide rod 115 may prevent cracks or other damage to the flexible display panel 111. That is, when the flexible display panel 111 is deformed by bending or any other manipulation, the guide rod 115 keeps the flexible display panel 111 at or above a predetermined curvature. As a consequence, tensile force applied to the outer surface of the flexible display panel 111 that has been bent can be restricted to below the yield stress Y. If the guide rod 115 is positioned on a display surface of the flexible display panel 111, it is preferred to dispose the guide rod 115 selectively on the flexible display panel 111. For example, the guide rod 115 may be disposed in such a manner that the guide rod 115 is outside the display area of the flexible display panel 111 and upon sensing the strain of the flexible display panel 111 almost reaching the strain tolerance, the guide rod 115 is positioned on the flexible display panel 111.

Figure 4:
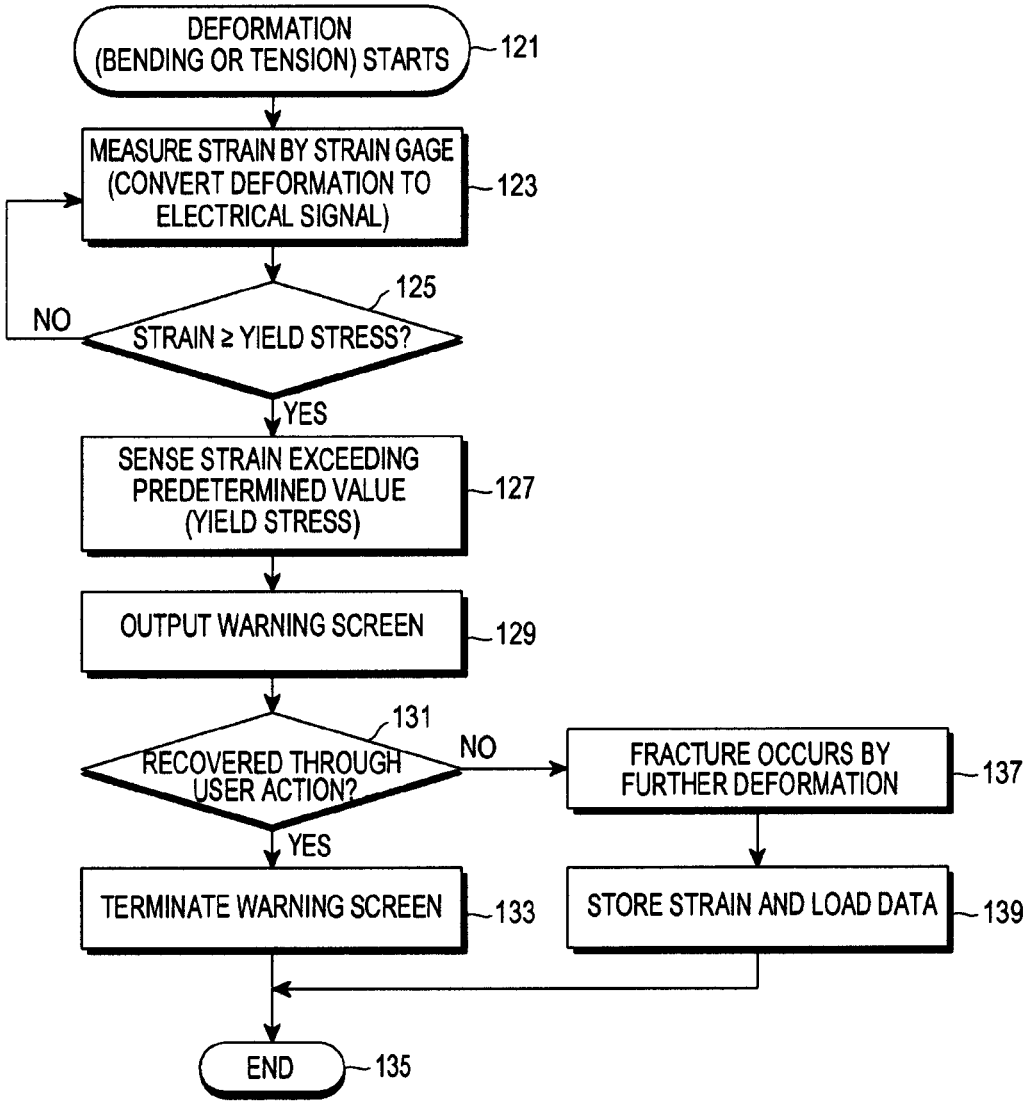
FIG. 4 is a flowchart illustrating a method for controlling the display device illustrated in FIG. 2.

FIG. 4 is a flowchart illustrating a method for controlling the display device 100 to prevent its permanent deformation or cracks.

Referring to FIG. 4, when the display device 100 having the strain gauges 113 on one surface of the flexible display panel 111 starts to be deformed due to bending force or tensile force applied to it in step 121, the strain gauges 113 measure the strain of the flexible display panel 111 in step 123. The strain measurement step 123 is continuously performed as long as the flexible display panel 111 is in a deformed state, not in a flat state. Even though the strain of the flexible display panel 111 does not reach a strain tolerance, that is, the yield stress Y, the strain gauges 113 monitors the strain of the flexible display panel 111 all the time as long as the flexible display panel 111 is in a non-flat state.

If the strain of the flexible display panel 111 reaches the yield stress Y in step 125, the strain gauges 113 sense the strain reaching near the yield stress Y in step 127, the strain gages 113 generate a warning signal and operates the display device 100, for example, the flexible display panel 111 to output a warning screen in step 129. The warning signal may be generated by a separate controller connected to the strain gauges 113. If the display device 100 is installed in a portable terminal, the portable terminal may emit an alarm sound according to the warning signal. The warning screen output from the flexible display panel 111 may be a flicking screen or a preset screen.

When a user views the warning screen or the like and stops the deformation of the display device 100, thereby returning the display device 100 to its flat form in step 131, the strain gauges 113 senses that the strain of the flexible display panel 111 is equal to or smaller than the yield stress Y, that is, the flexible display panel 111 is placed in a secure state where there is no risk of permanent deformation or cracks and thus discontinues generation of the warning signal. Therefore, the warning screen output from the flexible display panel 111 or the alarm sound from the portable terminal is discontinued in step 133.

On the other hand, if the user does not perceive or here the warning screen or the alarm sound yet and the deformation of the display device 100 further proceeds, the flexible display panel 111 is eventually permanently deformed, cracked, or fractured in step 137. A strain gauge corresponding to a cracked or fractured part provides data about a strain, load, position, etc. measured at the moment of cracking or facture to a controller and thus the controller stores the data in step 139. The stored data may be used to repair the display device 100 or improve the quality of later manufactured display devices.

After the series of steps, control of the display device 100 is completed in step 135. However, this is done for the convenience' sake of description. That is, in the case where the flexible display panel 111 is deformed by a stress equal to or smaller than the yield stress Y, if the warning screen is discontinued, the strain gauges 113 repeats the strain measurement step 123.

As is apparent from the above description, the display device of the present invention is configured such that the strain gauges are arranged on one surface of the flexible display panel in order to measure the strain of the flexible display panel and when needed, output a warning screen. Therefore, since a user can readily identify that the flexible display panel has reached a yield stress, he or she may control the deformation of the flexible display panel to prevent a permanent deformation or cracks of the flexible display panel.

In other words, according to the display device and the method for controlling the same according to the present invention, the strain gauges on one surface of the flexible display panel monitor the strain of the flexible display panel caused by its bending. As a warning signal or the like is generated before the strain measurement reaches a predetermined value, that is, a strain tolerance at which no cracks are made, the user is alarmed to the situation. Thus the user may prevent immediate or future cracks by stopping the deformation of the display device having flexibility according to the warning signal from the display device. Furthermore, even though the flexible display panel is permanently deformed or cracked, data about the deformation or cracks is stored for future use in improving the quality of products.

The above-described methods according to the present invention can be implemented in hardware, firmware or as software or computer code that can be stored in a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

While the present invention has been particularly shown and described with reference to embodiments thereof, it will be understood by those of ordinary skill in the art that various changes in form and details may be made therein without departing from the spirit and scope of the present invention as defined by the following claims.

What is claimed is:

1. A display device comprising:

a flexible display panel;

a plurality of strain gauges arranged on at least one surface of the flexible display panel to sense strain by sensing changes in electrical resistance of a conductive wire due to deformation of the flexible display panel;

a memory: and a processor configured to: receive data measured by the strain gauges, cause the display panel to display a warning screen when the sensed strain is near a threshold that corresponds to a permanent deformation of the flexible display, and store data in the memory about a sensed strain that results in the permanent deformation.

2. The display device of claim 1, further comprising a guide rod disposed on a surface of the flexible display panel for maintaining the flexible display panel at or above a predetermined curvature.

3. The display device of claim 2, wherein when the strain gauges sense that the flexible display panel is folded at or below a predetermined angle, the guide rod disposed on the surface of the flexible display panel maintains the flexible display panel at or above the predetermined curvature.

4. The display device of claim 1, wherein the display panel has a generally rectangular shape, and the strain gauges are arranged at a predetermined interval along an entire periphery of the display panel so that strain of the display panel is sensed when deformation occurs in any direction.

5. The display device of claim 1, further comprising an audio unit for alerting when the strain gauges sense that bending deformation of the flexible display panel reaches a strain tolerance.

6. A method comprising:

measuring changes in electrical resistance of a conductive wire due to a strain caused by deformation of a flexible display panel of a display device, the changes in electrical resistance being measured with a plurality of strain gauges, the plurality of strain gauges being arranged on at least one surface of the flexible display panel;

generating a warning signal when it is sensed that the strain of the flexible display panel is near a strain tolerance that corresponds to a permanent deformation of the flexible display during measuring the strain;

outputting a warning screen by operating the flexible display panel according to the warning signal; and storing data in a memory of the display device about a strain that results in a permanent deformation.

7. The method of claim 6, further comprising discontinuing the generation of the warning signal and terminating the warning screen, when the flexible display panel is recovered and the strain of the flexible display panel is decreased to below the strain tolerance during generation of the warning signal and outputting of the warning screen.

8. The method of claim 6, wherein the display panel has a generally rectangular shape, and the strain gauges are arranged at a predetermined interval along an entire periphery of the display panel so that strain of the display panel is sensed when deformation occurs in any direction.

* * * * *

UNITED STATES PATENT AND TRADEMARK OFFICE

CERTIFICATE OF CORRECTION

PATENT NO. : 9,007,226 B2
APPLICATION NO. : 13/616621
DATED : April 14, 2015
INVENTOR(S) : Min-Su Chang It is certified that error appears in the above-identified patent and that said Letters Patent is hereby corrected as shown below:

In The Claims

Column 6, Claim 1, Line 11 should read as follows:
--...a memory; and...--

Signed and Sealed this
Seventh Day of July, 2015

Michelle K. Lee

Michelle K. Lee
*Director of the United States Patent and Trademark Office*